US011199798B2

(12) United States Patent
Morishita

(10) Patent No.: US 11,199,798 B2
(45) Date of Patent: Dec. 14, 2021

(54) ELECTRONIC APPARATUS THAT INCLUDES MOTOR SUPPLIED WITH POWER FROM AT LEAST TWO POWER SUPPLY UNITS

(71) Applicant: CANON KABUSHIKI KAISHA, Tokyo (JP)

(72) Inventor: Yusuke Morishita, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/028,780

(22) Filed: Sep. 22, 2020

(65) Prior Publication Data

US 2021/0096490 A1 Apr. 1, 2021

(30) Foreign Application Priority Data

Sep. 30, 2019 (JP) ..... JP2019-180374

(51) Int. Cl.
*G03G 15/00* (2006.01)

(52) U.S. Cl.
CPC ..... *G03G 15/5004* (2013.01); *G03G 15/5008* (2013.01)

(58) Field of Classification Search
CPC ..... G03G 21/203; G03G 21/206
See application file for complete search history.

(56) References Cited

U.S. PATENT DOCUMENTS 4,922,401 A * 5/1990 Lipman ..... H02M 7/519 363/58
5,144,366 A * 9/1992 Sakamoto ..... G03G 21/206 355/30
5,647,727 A * 7/1997 Taniguchi ..... G03G 21/206 355/30
5,860,042 A * 1/1999 Tomaru ..... H04N 1/00519 399/92

FOREIGN PATENT DOCUMENTS

JP 2007-142047 A 6/2007

* cited by examiner

*Primary Examiner* — Victor Verbitsky
(74) *Attorney, Agent, or Firm* — Canon U.S.A., Inc. I.P. Division

(57) ABSTRACT

An electronic apparatus includes a motor, a first power supply unit, a second power supply unit, a control unit, and a delay unit. The first power supply unit supplies a first voltage to the motor. The second power supply unit supplies a second voltage higher than the first voltage to the motor. The control unit supplies and stops supplying the second voltage from the second power supply unit to the motor while supplying the first voltage from the first power supply unit to the motor. The delay unit delays a rise in the second voltage supplied from the second power supply unit to the motor.

11 Claims, 9 Drawing Sheets

ELECTRONIC APPARATUS THAT INCLUDES MOTOR SUPPLIED WITH POWER FROM AT LEAST TWO POWER SUPPLY UNITS

BACKGROUND

Field

The present disclosure relates to an electronic apparatus that includes a motor supplied with power from at least two power supply units.

Description of the Related Art

An image forming apparatus, such as an electrophotographic copy machine, maintains image quality by keeping photoconductive drums at a constant temperature. In order to keep the photoconductive drums at a constant temperature, the image forming apparatus controls a fan motor disposed in the image forming apparatus. Japanese Patent Application Laid-Open No. 2007-142047 discusses a technique that enables a fan to rotate at a low speed during standby and to rotate at a high speed after startup of a main controller. In Japanese Patent Application Laid-Open No. 2007-142047, a fan unit is configured to be supplied with a plurality of voltages (12 V and 5 V). The fan unit is supplied with 5 V during standby and is supplied with 12 V after startup of the main controller.

In the method discussed in Japanese Patent Application Laid-Open No. 2007-142047, however, the fan unit is only supplied with 5 V or 12 V. Thus, a fan motor can be rotated at only two rotation speeds including a low speed and a high speed. In other words, in Japanese Patent Application Laid-Open No. 2007-142047, the fan motor cannot be rotated at a speed between the low speed and the high speed.

Although not discussed in Japanese Patent Application Laid-Open No. 2007-142047, a direct current to direct current (DC-DC) converter circuit may be used to step down 12 V output from a power unit and thereby supply the fan unit with a voltage between 5 V and 12 V. Alternatively, a DC-DC converter circuit may be used to step up 5 V output from a DC-DC converter (DDC) and thereby supply the fan unit with a voltage between 5 V and 12 V.

However, if a DC-DC converter circuit is additionally provided, the circuit cost and the circuit mounting area will increase.

SUMMARY

The present disclosure is directed to finely controlling the rotation speed of a motor by supplying the motor with a voltage corresponding to a value between two voltage values. Further, the present disclosure is directed to preventing a rush current from flowing into the motor.

According to an aspect of the present disclosure, an electronic apparatus includes a motor, a first power supply unit configured to supply a first voltage to the motor, a second power supply unit configured to supply a second voltage higher than the first voltage to the motor, a control unit configured to supply and stop supplying the second voltage from the second power supply unit to the motor while supplying the first voltage from the first power supply unit to the motor, and a delay unit configured to delay a rise in the second voltage supplied from the second power supply unit to the motor.

Further features of the present disclosure will become apparent from the following description of exemplary embodiments with reference to the attached drawings.

DESCRIPTION OF THE EMBODIMENTS

Exemplary embodiments of the present disclosure will be described with reference to the drawings. Hereinafter, an image forming apparatus with a printing function will be described as an example of an electronic apparatus.

Figure 1:
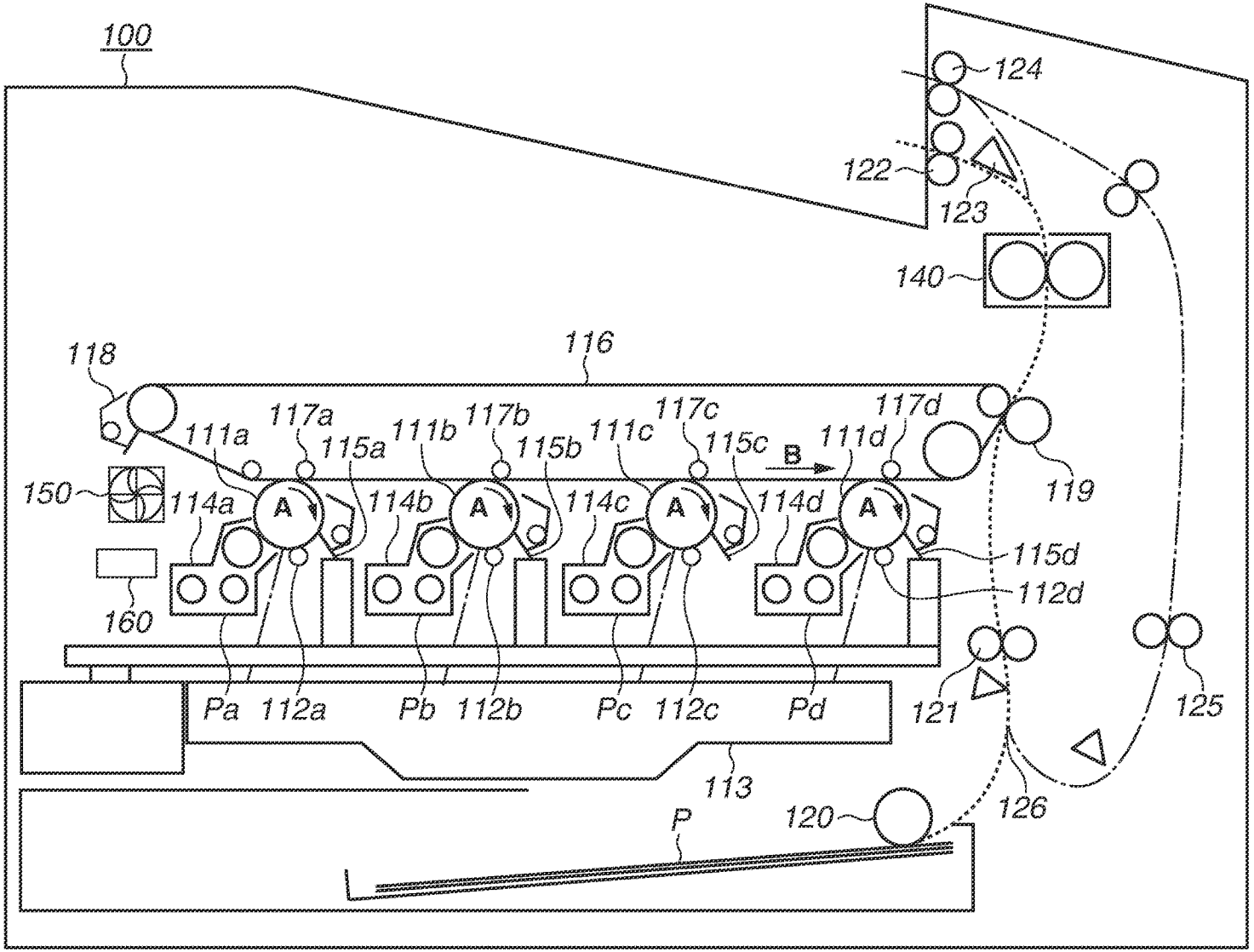
FIG. 1 is a diagram illustrating an internal configuration of an image forming apparatus.

A first exemplary embodiment will be described. FIG. 1 is a diagram illustrating an internal configuration of an image forming apparatus 100. The image forming apparatus 100 includes photoconductive drums 111*a*, 111*b*, 111*c*, and 111*d* that correspond to colors of yellow, magenta, cyan, and black, respectively. A charging unit 112*a* and an exposure unit 113 are arranged near the photoconductive drum 111*a*. The charging unit 112*a* uniformly charges a surface of the photoconductive drum 111*a*. The exposure unit 113 emits a laser beam, which is modulated based on information about an image to be recorded, onto the charged surface of the photoconductive drum 111*a*. A development unit 114*a* is also arranged near the photoconductive drum 111*a*. The development unit 114*a* develops a latent image formed on the surface of the photoconductive drum 11*a* by the laser beam emitted from the exposure unit 113. Furthermore, a cleaning unit 115*a* is arranged near the photoconductive drum 111*a*. The cleaning unit 115*a* cleans and collects toner that remains on the surface of the photoconductive drum 111*a*. Configurations near the photoconductive drums 111*b*, 111*c*, and 111*d* are similar to the configuration near the photoconductive drum 111*a*, except for the toner colors used, and positions from which the exposure unit 113 emits the laser beam. The photoconductive drums 111*a*, 111*b*, 111*c*, and 111*d*, the charging units 112*a*, 112*b*, 112*c*, and 112*d*, the development units 114*a*, 114*b*, 114*c*, and 114*d*, and the cleaning units 115*a*, 115*b*, 115*c*, and 115*d* are combined respectively for the respective colors, and are collectively referred to as process units.

An intermediate transfer belt 116 is arranged over the photoconductive drums 111*a*, 111*b*, 111*c*, and 111*d*. Toner images on the photoconductive drums 111*a*, 111*b*, 111*c*, and 111*d* are transferred to the intermediate transfer belt 116. Primary transfer rollers 117*a*, 117*b*, 117*c*, and 117*d* are arranged inside the intermediate transfer belt 116, and are at positions opposing the photoconductive drums 111*a*, 111*b*, 111*c*, and 111*d*, respectively. A belt cleaning unit 118 is arranged near the intermediate transfer belt 116. The belt cleaning unit 118 collects toner that remains on a surface of the intermediate transfer belt 116. A second transfer roller 119 is arranged near the intermediate transfer belt 116, and is on an opposite side to a side where the belt cleaning unit 118 is arranged.

A feed roller 120, which is connected to a feed motor (not illustrated), feeds a recording sheet P. The recording sheet P passes on a one-sided printing conveyance path (indicated by a broken line in FIG. 1), passes through a registration roller 121 used for skew correction, and is conveyed to a transfer position between the intermediate transfer belt 116 and the second transfer roller 119. A fixing unit 140 and a discharge roller 122 are arranged on a downstream side in a conveyance direction of the recording sheet P that has passed the transfer position.

The fixing unit 140 fixes an image onto a front or back side of the recording sheet P. Then, when duplex printing is performed, a reversing flapper 123 switches the conveyance path, and a reversing roller 124 rotates in a forward direction and then in a reverse direction so that the recording sheet P passes on a duplex-printing conveyance path (indicated by a chain line in FIG. 1). The recording sheet P passes through a duplex-printing roller 125, and passes a joint point 126 where the one-sided printing conveyance path and the duplex-printing conveyance path are joined together. Then again, the recording sheet P passes through the registration roller 121 and is conveyed to the transfer position.

The above-described process units including the photoconductive drums 111*a*, 111*b*, 111*c*, and 111*d* may affect image quality due to the inside temperature of the image forming apparatus 100. The inside temperature of the image forming apparatus 100 may also affect durable lifetime of the photoconductive drums 111*a*, 111*b*, 111*c*, and 111*d*. During printing, a temperature around the process units is controlled within a predetermined target temperature range. In order to control the temperature, a fan unit 150 is provided to generate an airflow in and around the process units. The fan unit 150 includes a fan 151 and a motor 152 (illustrated in FIG. 2). The fan 151 cools devices in the image forming apparatus 100. The motor 152 drives and rotates the fan 151. A temperature sensor 160 is provided near the process units to detect the temperature around the process units.

Figure 2:
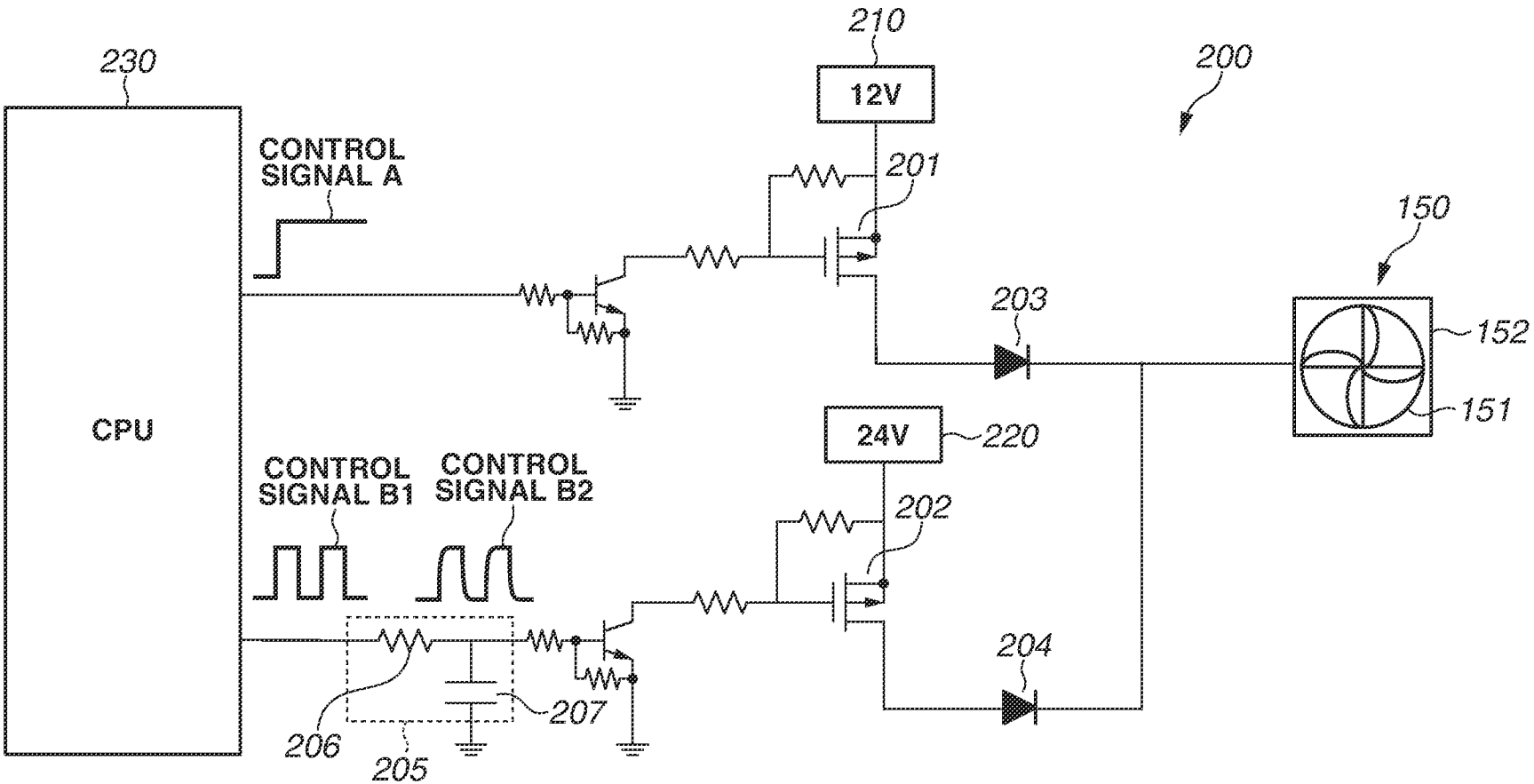
FIG. 2 is a circuit diagram illustrating details of a control circuit of a fan unit.

FIG. 2 is a circuit diagram illustrating details of a control circuit 200 of the fan unit 150. The fan unit 150 includes the fan 151 and the motor 152. The fan 151 cools the devices including the photoconductive drums 111*a*, 111*b*, 111*c*, and 111*d*, and the fixing unit 140 in the image forming apparatus 100. The motor 152 drives and rotates the fan 151.

The motor 152 is a direct current motor (DC motor). A rotation speed of the motor 152 changes in response to a supplied voltage. The motor 152 according to the present exemplary embodiment is supplied with 12 V and 24 V. The motor 152 supplied with 24 V rotates at a full speed. The motor 152 supplied with 12 V rotates at a half speed. In addition, in the present exemplary embodiment, the voltage of 24 V is controlled using pulse width modulation (PWM). As a result, the motor 152 can rotate at a speed between the full speed and the half speed. Voltages supplied to the motor 152 are not limited to 12V and 24V.

A power supply unit (first power supply unit) 210 outputs 12 V. A field effect transistor (FET) 201 is provided between the power supply unit 210 and the motor 152. A power supply unit (second power supply unit) 220 outputs 24 V. An FET 202 is provided between the power supply unit 220 and the motor 152. The FET 201 turns on or off the voltage output from the power supply unit 210. The FET 202 turns on or off the voltage output from the power supply unit 220.

In the present exemplary embodiment, diodes 203 and 204 are provided to prevent, when either one of the voltage output from the power supply unit 210 and the voltage output from the power supply unit 220 is turned on, an electric current from flowing into the turned-off side.

A central processing unit (CPU)(control unit) 230 outputs a signal that turns on or off the FET 201 (second switch), and outputs a signal that turns on or off the FET 202 (first switch). The CPU 230 according to the present exemplary embodiment controls a control signal B1 so that the FET 202 is alternately turned on and off and the control signal B1 is alternately at a high level and a low level while the FET 201 is kept on (while a control signal A is kept at a high level). The CPU 230 can also adjust a duty ratio of a high level period of the control signal B1.

The control circuit 200 according to the present exemplary embodiment includes a delay circuit (delay unit) 205. The delay circuit 205 delays a time at which a voltage of the control signal B1 reaches a target voltage (which is 3.3 V in the present exemplary embodiment). The delay circuit 205 is a resistor-capacitor (RC) circuit, and includes a resistor 206 and a capacitor 207. A rise in a voltage of a control signal B2 output from the delay circuit 205 is slower than a rise in the voltage of the control signal B.

Figure 3A:
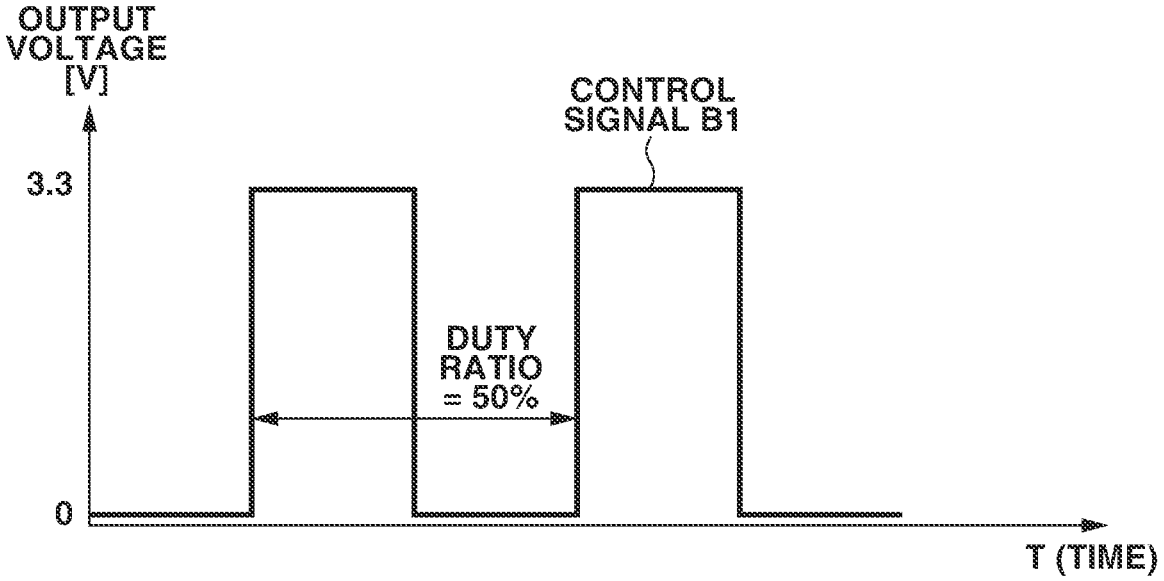
FIG. 3A is a chart illustrating control signals B1 and B2 with a duty ratio of 50%.
Figure 3A:
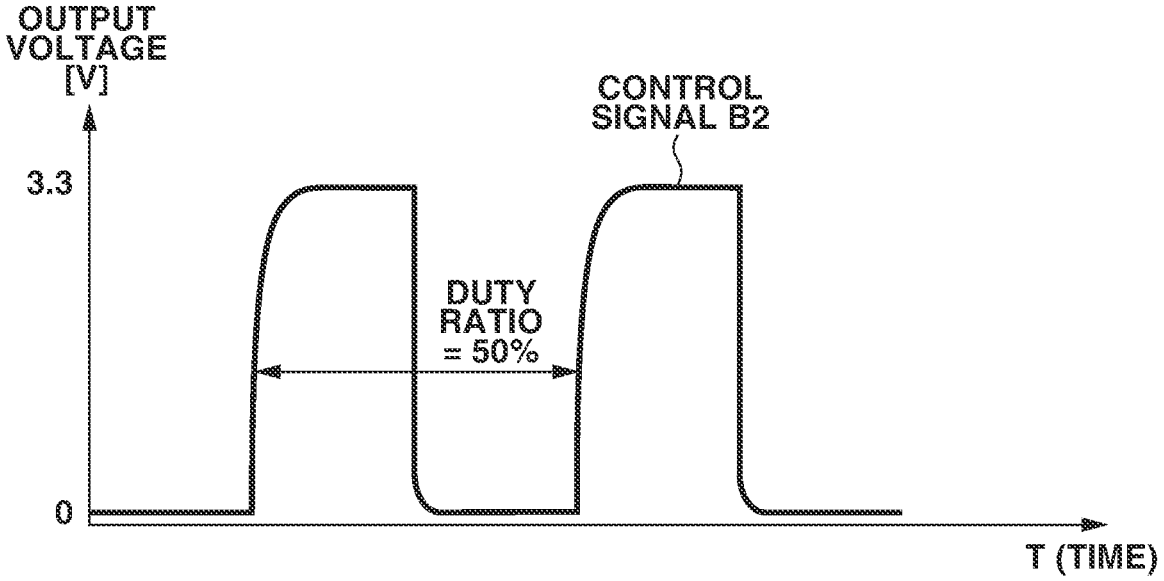
Figure 3B:
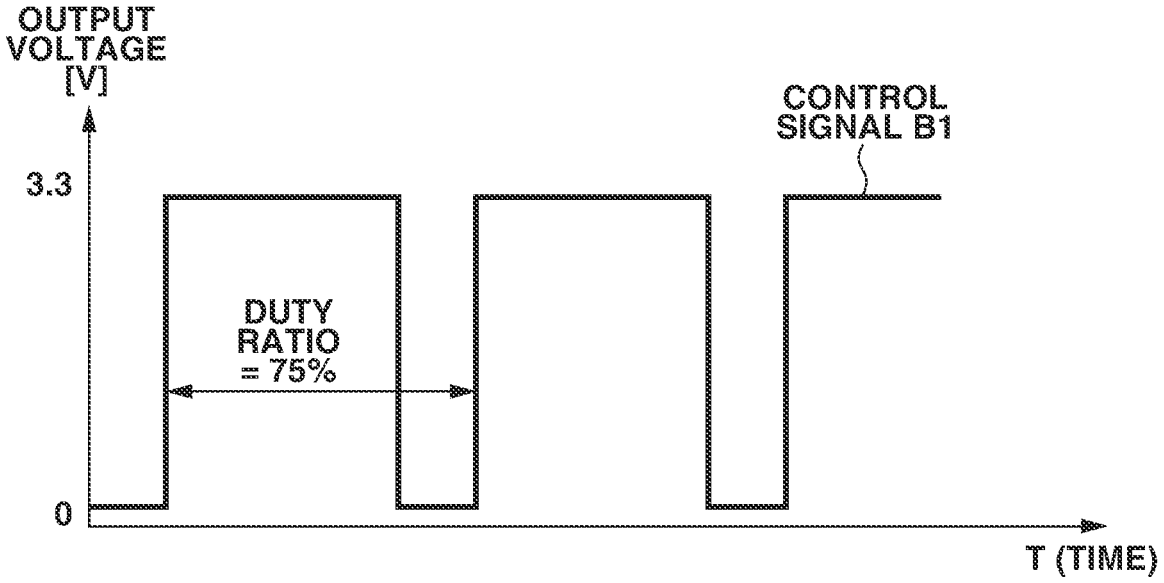
FIG. 3B is a chart illustrating control signals B1 and B2 with a duty ratio of 75%.
Figure 3B:
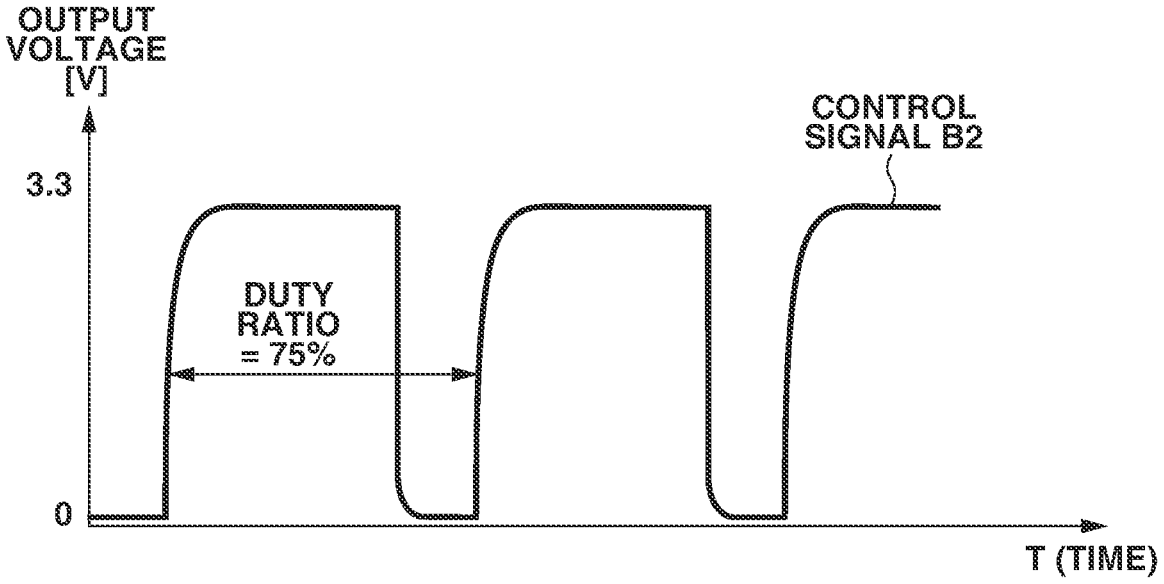
Figure 3C:
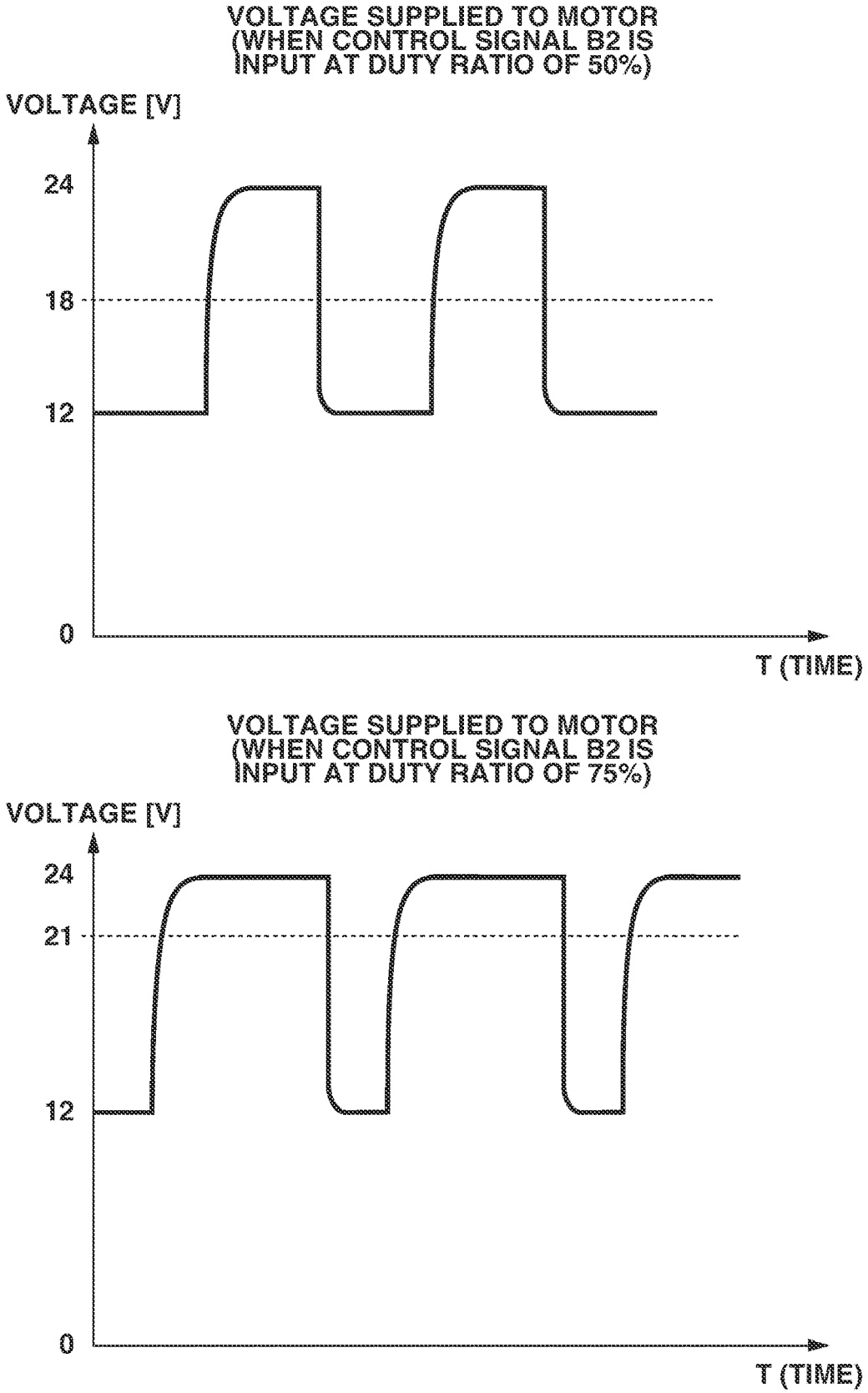
FIG. 3C is a chart illustrating voltages supplied to a motor.

FIG. 3C is a chart illustrating voltages supplied to the motor 152.

First, a method of supplying 12 V or 24 V to the motor 152 will be described. When 12 V is supplied to the motor 152, the FET 201 (illustrated in FIG. 2) is turned on and the FET 202 (illustrated in FIG. 2) is turned off. Accordingly, the motor 152 rotates at a half speed. When 24 V is supplied to the motor 152, the FET 202 (illustrated in FIG. 2) is turned on and the FET 201 (illustrated in FIG. 2) is turned off. Accordingly, the motor 152 rotates at a full speed. Alternatively, the FET 201 may be turned on.

Next, a method of supplying a voltage equivalent to 18 V to the motor 152 will be described. When a voltage equivalent to 18 V is supplied to the motor 152, the FET 202 is turned on at a duty ratio of 50% in a state where the FET 201 is turned on. The duty ratio according to the present exemplary embodiment refers to the ratio of the time, during which the FET 202 is turned on, to a predetermined period of time. When the FET 202 is turned on at a duty ratio of 50%, a voltage illustrated in the upper graph of FIG. 3C is supplied to the motor 152. The voltage supplied to the motor 152 toggles between 12 V and 24 V. A ratio between a time for supplying 12 V and a time for supplying 24 V is 1:1. An average voltage supplied to the motor 152 is 18 V.

Next, a method of supplying a voltage equivalent to 21 V to the motor 152 will be described. When a voltage equivalent to 21 V is supplied to the motor 152, the FET 202 is turned on at a duty ratio of 75% in a state where the FET 201 is turned on. The duty ratio according to the present exemplary embodiment refers to the ratio of the time, during which the FET 202 is turned on, to a predetermined period of time. When the FET 202 is turned on at a duty ratio of 75%, a voltage illustrated in the lower graph of FIG. 3C is supplied to the motor 152. The voltage supplied to the motor 152 toggles between 12 V and 24 V. The ratio between the time for supplying 12 V and the time for supplying 24 V is 1:3. The average voltage supplied to the motor 152 is 21 V.

Figure 4:
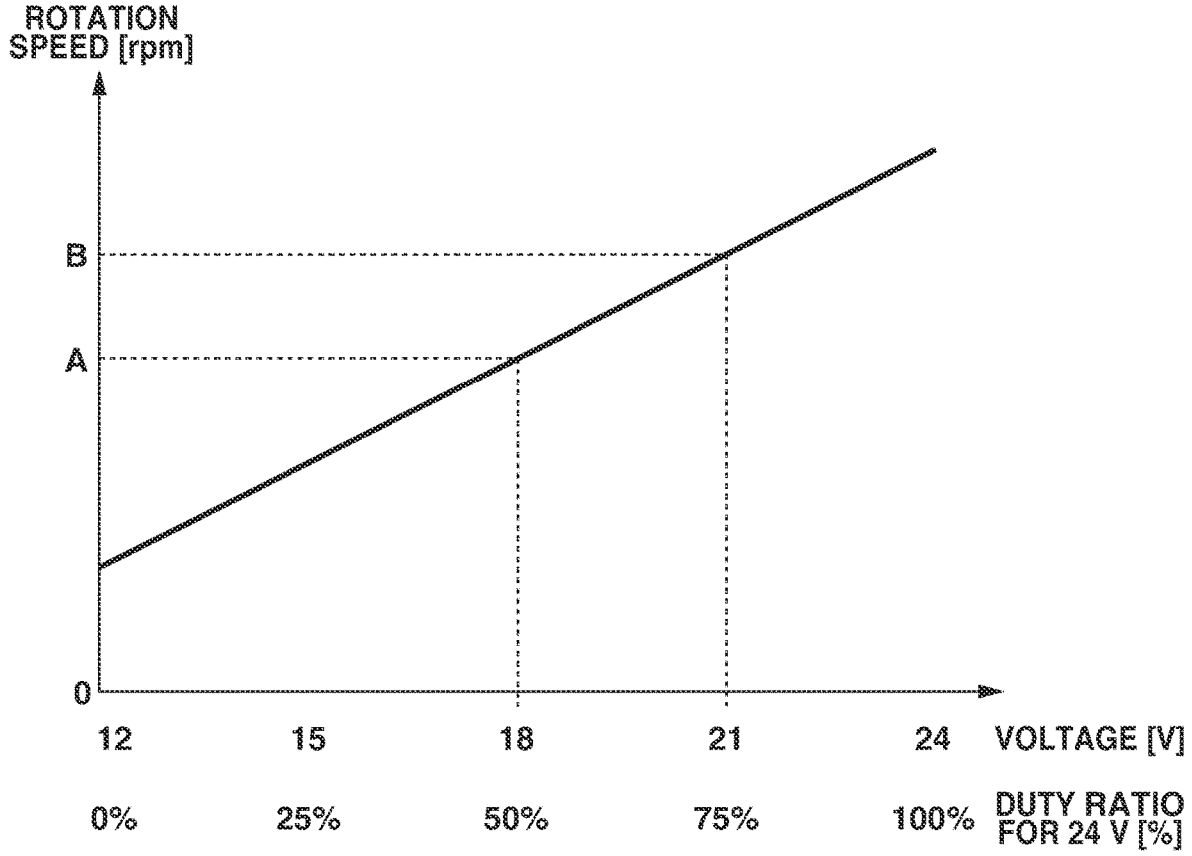
FIG. 4 is a graph illustrating a relationship between a voltage supplied to the motor (a duty ratio) and a rotation speed of the motor.

As described above, a voltage corresponding to a value between 12 V and 24 V can be supplied to the motor 152 by alternately turning on and off the FET 202 in a state where the FET 201 is turned on. FIG. 4 is a graph illustrating a relationship between the voltage supplied to the motor 152 (duty ratio) and the rotation speed of the motor 152. The rotation speed of the motor 152 according to the present exemplary embodiment is proportional to a supplied voltage.

In the present exemplary embodiment, the FET 201 is kept on while the FET 202 is alternately turned on and off. With the FET 201 on, the lowest voltage supplied to the motor 152 is 12 V, and the voltage supplied to the motor 152 varies between 12 V and 24 V. Variation in the voltage supplied to the motor 152 is smaller than that of when the voltage varies between 0 V and 24 V. Accordingly, variation in the rotation speed of the motor 152 is reduced. As a result, sounds and vibrations due to rotation of the fan 151 can be suppressed.

In the present exemplary embodiment, the FET 201 is kept on while the FET 202 is alternately turned on and off. Alternatively, the FET 201 can be kept off. When a voltage equivalent to 18 V is supplied to the motor 152 with the FET 201 off, the FET 202 is turned on at a duty ratio of 75%. When a voltage equivalent to 21 V is supplied to the motor 152 with the FET 201 off, the FET 202 is turned on at a duty ratio of 87.5%.

Figure 5:
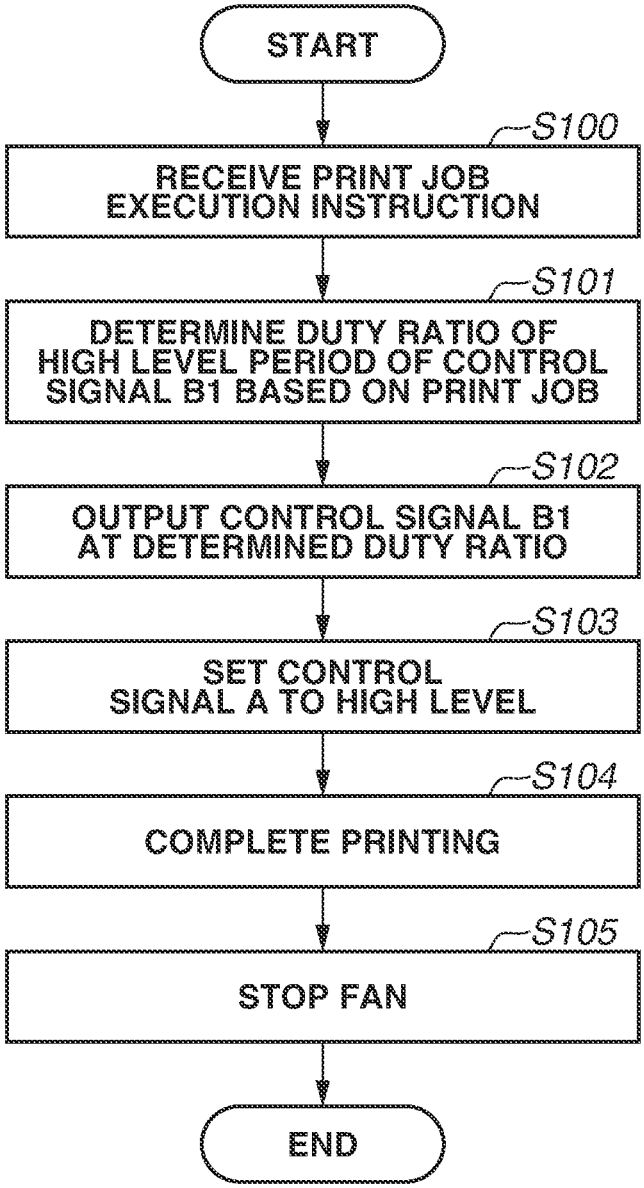
FIG. 5 is a flowchart illustrating a control method of a fan.

FIG. 5 is a flowchart illustrating a control method of the fan 151.

First, the image forming apparatus 100 receives a print job from an external apparatus. When the image forming apparatus 100 receives an instruction to execute the received print job, the image forming apparatus 100 starts printing. When the CPU 230 receives the print job execution instruction in step S100, then in step S101, the CPU 230 determines the duty ratio of the high level period of the control signal B1 based on the print job.

Based on contents of the print job, conditions that cause a change in the inside temperature of the image forming apparatus 100, including a rotation speed of a conveyance motor for conveying a recording medium such as paper and a fixing temperature of the fixing unit 140, are determined. Thus, in the present exemplary embodiment, in step S101, the CPU 230 determines the duty ratio of the high level period of the control signal B1 based on the contents of the print job. For example, the CPU 230 determines the duty ratio of the high level period of the control signal B1 based on a size of a recording medium used for printing. When the recording medium is long, the CPU 230 increases the duty ratio of the high level period of the control signal B1 to increase the rotation speed of the fan 151. When the recording medium is thick paper, the CPU 230 increases the duty ratio of the high level period of the control signal B1 to increase the rotation speed of the fan 151. Alternatively, the CPU 230 may determine the duty ratio of the high level period of the control signal B1 based on a grammage of the recording medium.

In step S102, the CPU 230 outputs the control signal B1 at the determined duty ratio. A rise of the control signal B1 is delayed by the delay circuit 205. The FET 202 is turned on and off by the control signal B2 whose rise is delayed by the delay circuit 205. In step S103, the CPU 230 sets the control signal A to a high level. Accordingly, the FET 201 is turned on by the control signal A. In step S102, the control signal B1 is output at the determined duty ratio. Alternatively, the control signal B1 may be fixed at a high level or a low level depending on the contents of the print job.

As described above, a voltage corresponding to a value equal to or lower than 24 V can be supplied to the motor 152 by alternately turning on and off the FET 202 that supplies 24 V to the motor 152. As a result, the rotation speed of the fan 151 rotated by the motor 152 can be finely adjusted.

In addition, variation in the voltage supplied to the motor 152 can be reduced by turning on the FET 201 that supplies 12 V to the motor 152 while the FET 202 is alternately turned on and off. As a result, variation in the rotation speed of the motor 152 can also be reduced, and sounds and vibrations due to the rotation of the fan 151 can be suppressed.

Furthermore, arise in the voltage supplied to the motor 152 can be delayed by the delay circuit 205 that delays a rise of the control signal B1. As a result, a rush current can be prevented from flowing into the motor 152.

When the printing is completed in step S104, then in step S105, the CPU 230 stops the motor 152 by setting the control signals A and B1 to low levels. The motor 152 may be stopped when any condition other than the completion of printing is satisfied. For example, the motor 152 may be stopped when a temperature indicated by temperature data output from the temperature sensor 160 is equal to or lower than a target temperature. Alternatively, the motor 152 may be stopped when a predetermined period of time passes after the completion of printing.

Figure 6:
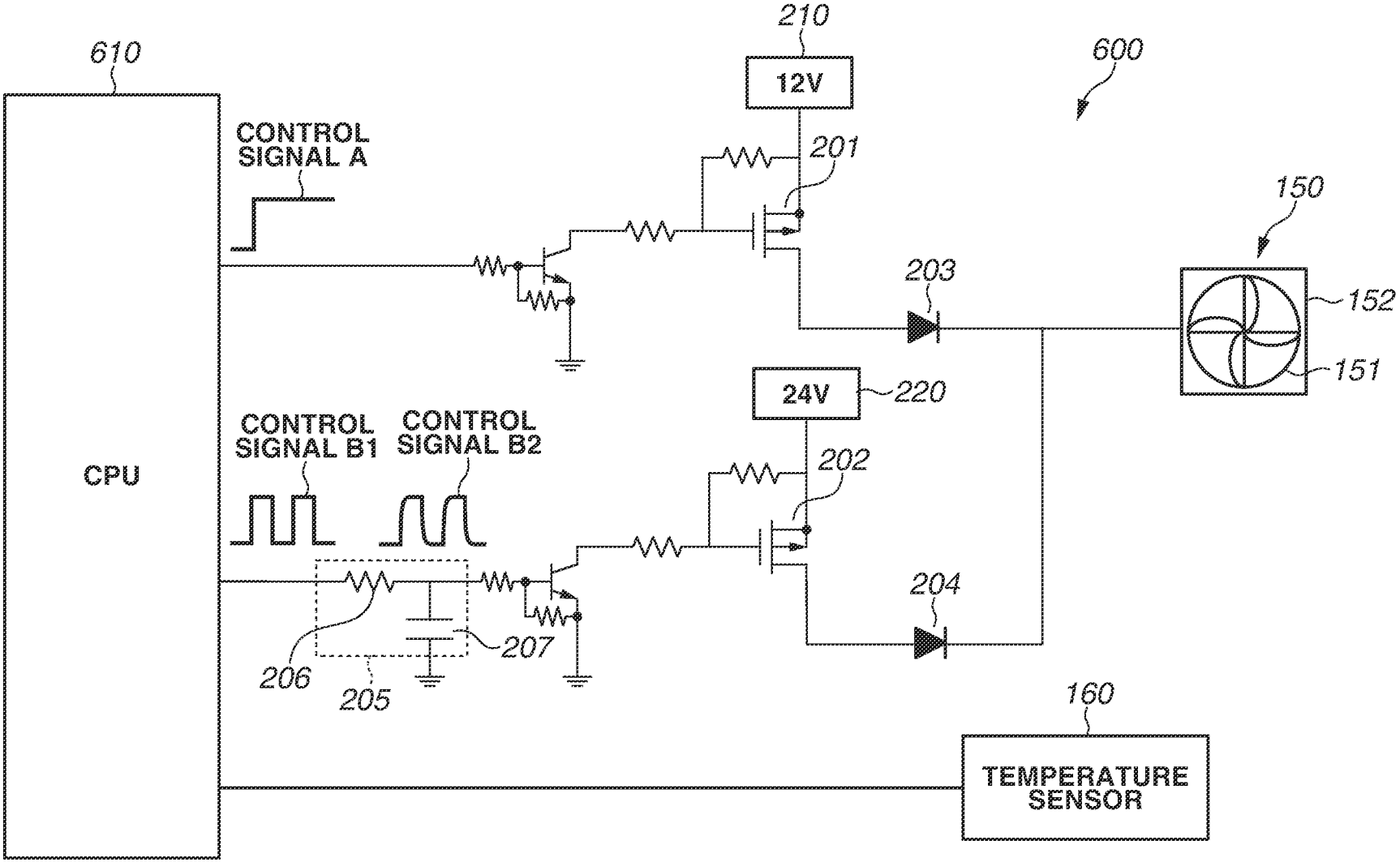
FIG. 6 is a circuit diagram illustrating details of a control circuit of a fan unit according to a second exemplary embodiment.

FIG. 6 is a circuit diagram illustrating details of a control circuit 600 of the fan unit 150 according to a second exemplary embodiment. The control circuit 600 is similar to the control circuit 200, except that the control circuit 600 uses the temperature data output from the temperature sensor 160.

A CPU 610 of the control circuit 600 controls the rotation speed of the motor 152 based on the temperature data output from the temperature sensor 160. The temperature sensor 160 is disposed near the components of the process units, such as the photoconductive drums 111*a*, 111*b*, 111*c*, and 111*d*, which have strict temperature constraints. The temperature sensor 160 senses a temperature and outputs temperature data to the CPU 610. The temperature data includes an analog value corresponding to the sensed temperature. The CPU 610 adjusts the duty ratio of the high level period of the control signal B1 based on the temperature data output from the temperature sensor 160.

For example, when the temperature data output from the temperature sensor 160 is higher than a target temperature, the CPU 610 increases the duty ratio of the high level period of the control signal B1. When the temperature data output from the temperature sensor 160 is lower than the target temperature, the CPU 610 decreases the duty ratio of the high level period of the control signal B1.

Figure 7:
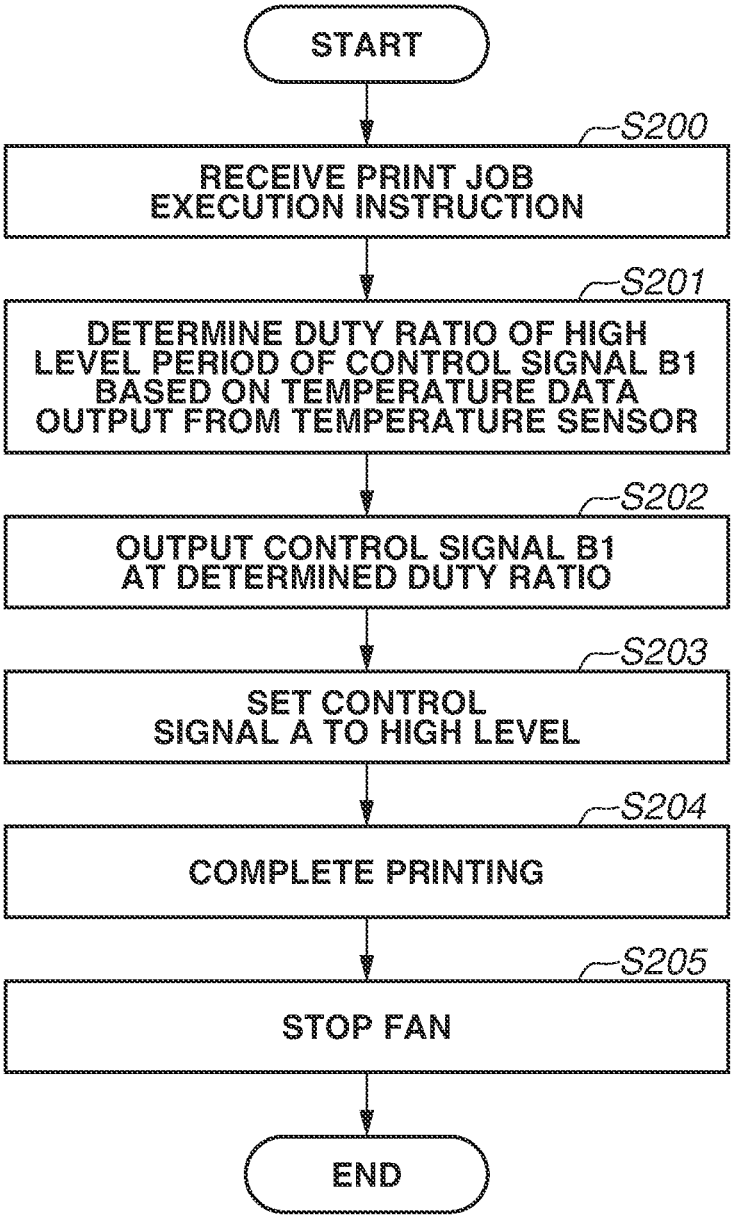
FIG. 7 is a flowchart illustrating a control method of a fan according to the second exemplary embodiment.

FIG. 7 is a flowchart illustrating a control method of the fan 151 according to the second exemplary embodiment.

First, the image forming apparatus 100 receives a print job from an external apparatus. When the image forming apparatus 100 receives an instruction to execute the received print job, the image forming apparatus 100 starts printing. When the CPU 610 receives the print job execution instruction in step S200, then in step S201, the CPU 610 determines the duty ratio of the high level period of the control signal B1 based on the temperature data output from the temperature sensor 160.

In step S202, the CPU 610 outputs the control signal B1 at the determined duty ratio. Accordingly, the FET 202 is turned on and off by the control signal B2 delayed by the delay circuit 205. In step S203, the CPU 610 sets the control signal A to a high level. Accordingly, the FET 201 is turned on by the control signal A. The processing after step S203 is similar to the processing according to the first exemplary embodiment, and thus the description thereof will be omitted.

In the second exemplary embodiment, the duty ratio of the high level period of the control signal B1 may be periodically adjusted based on the temperature data output from the temperature sensor 160. As described above, the rotation speed of the fan 151 can be finely controlled based on the temperature data output from the temperature sensor 160.

In the above-described exemplary embodiments, the example of applying the present disclosure to an image forming apparatus has been described. However, the scope of the present disclosure is not limited thereto. The present disclosure is applicable to an information processing apparatus including a motor that rotates a head of a hard disk (HDD), such as a personal computer (PC) or a server. In addition, the present disclosure is applicable to an air conditioner (indoor unit) including a motor that drives a fan. Furthermore, the present disclosure is applicable to a vehicle.

The above-described exemplary embodiments may be implemented in a processing form in which a program that implements at least one function is supplied to a system or an apparatus via a network or a storage medium and then is read and executed by at least one processor of a computer in the system or the apparatus. Alternatively, the above-described exemplary embodiments may be implemented by a circuit (for example, an application specific integrated circuit (ASIC)) that implements at least one function.

In the first exemplary embodiment, the duty ratio of the high level period of the control signal B1 is determined based on the contents of the print job. In the second exemplary embodiment, the duty ratio of the high level period of the control signal B1 is determined based on the temperature data output from the temperature sensor 160. Alternatively, the duty ratio of the high level period of the control signal B1 can be determined based on the contents of the print job and then adjusted based on the temperature data output from the temperature sensor 160.

In the above-described exemplary embodiments, the present disclosure is applied to the motor that rotates the fan. However, the scope of the present disclosure is not limited thereto. For example, the present disclosure is applicable to a conveyance motor that conveys paper and a fan that cools a processor.

In the above-described exemplary embodiments, an RC circuit is used as the delay circuit 205. However, the delay circuit 205 is not limited to the RC circuit as long as the delay circuit 205 can delay the rise in the voltage supplied to the motor 152.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-180374, filed Sep. 30, 2019, which is hereby incorporated by reference herein in its entirety.

What is claimed is:

1. An electronic apparatus comprising:

a motor;

a first power supply unit configured to supply a first voltage to the motor;

a second power supply unit configured to supply a second voltage higher than the first voltage via a switch to the motor;

a control unit configured to output a control signal via a delay unit to the switch for controlling supply of the second voltage from the second power supply unit to the motor while the first voltage from the first power supply unit is kept to be supplied to the motor;

the delay unit, wherein the delay unit is configured to delay a rise of the control signal; and the switch, wherein the switch is disposed between the second power supply unit and the motor and is configured to receive the control signal whose rise has been delayed by the delay unit and adjust an amount of the second voltage to be supplied to the motor.

2. The electronic apparatus according to claim 1, wherein the delay unit is a resistor-capacitor circuit.

3. The electronic apparatus according to claim 1, wherein the control unit is configured to alternately supply and stop supplying the second voltage from the second power supply unit to the motor while the first voltage is kept to be supplied from the first power supply unit to the motor.

4. The electronic apparatus according to claim 1, wherein the control unit is configured to alternately turn on and off the switch while the first voltage from the first power supply unit is kept to be supplied to the motor.

5. The electronic apparatus according to claim 1, further comprising another switch disposed between the first power supply unit and the motor, wherein the control unit is configured to turn on and off the another switch.

6. The electronic apparatus according to claim 1, further comprising a fan, wherein the motor is configured to rotate the fan.

7. The electronic apparatus according to claim 6, wherein the fan is configured to cool a device in the electronic apparatus.

8. The electronic apparatus according to claim 1, further comprising a printing unit configured to print an image on a recording medium.

9. The electronic apparatus according to claim 1, wherein the control unit is configured to determine a time for supplying the second voltage to the motor in a predetermined period of time, based on a content of a received print job.

10. The electronic apparatus according to claim 9, wherein the content of the received print job is at least one of a size of a recording medium used for printing or a grammage of the recording medium.

11. The electronic apparatus according to claim 1, further comprising a temperature sensor, wherein the control unit is configured to determine a time for supplying the second voltage to the motor in a predetermined period of time, based on temperature data output from the temperature sensor.

* * * * *